United States Patent [19]

Collins

[11] 4,326,635

[45] Apr. 27, 1982

[54] APPARATUS FOR REFINING ORE

[76] Inventor: Wayne H. Collins, 337 Essex St., Kearny, Ariz. 85237

[21] Appl. No.: 203,261

[22] Filed: Nov. 3, 1980

[51] Int. Cl.[3] ..... B03B 4/00

[52] U.S. Cl. ..... 209/474; 209/44; 209/486

[58] Field of Search ..... 209/44, 486, 466–469, 209/474–476, 506, 485

[56] References Cited

U.S. PATENT DOCUMENTS

| | | | |
|---|---|---|---|
| 556,779 | 3/1896 | Shufelt | 209/474 |
| 588,252 | 8/1897 | Waer | 209/486 X |
| 945,857 | 1/1910 | McGowan | 209/466 |
| 954,580 | 4/1910 | Palmer | 209/44 X |
| 984,866 | 2/1911 | Tate | 209/467 |
| 1,076,397 | 10/1913 | Stewart et al. | 209/44 |

FOREIGN PATENT DOCUMENTS

| | | | |
|---|---|---|---|
| 108726 | 10/1939 | Australia | 209/44 |
| 28745 | of 1912 | United Kingdom | 209/486 |

*Primary Examiner*—Ralph J. Hill
*Attorney, Agent, or Firm*—Harry M. Weiss

[57] ABSTRACT

This disclosure relates to a refining apparatus which incorporates an updraft passing through a surface, which surface has permeable and impermeable regions, in combination with a vibrator, to serve as a device to fluidly suspend a mixture of materials above the surface so that the heavier constituents of the mixture of materials tend to migrate to the surface and remain upon the impermeable regions.

10 Claims, 4 Drawing Figures

FIG. 1
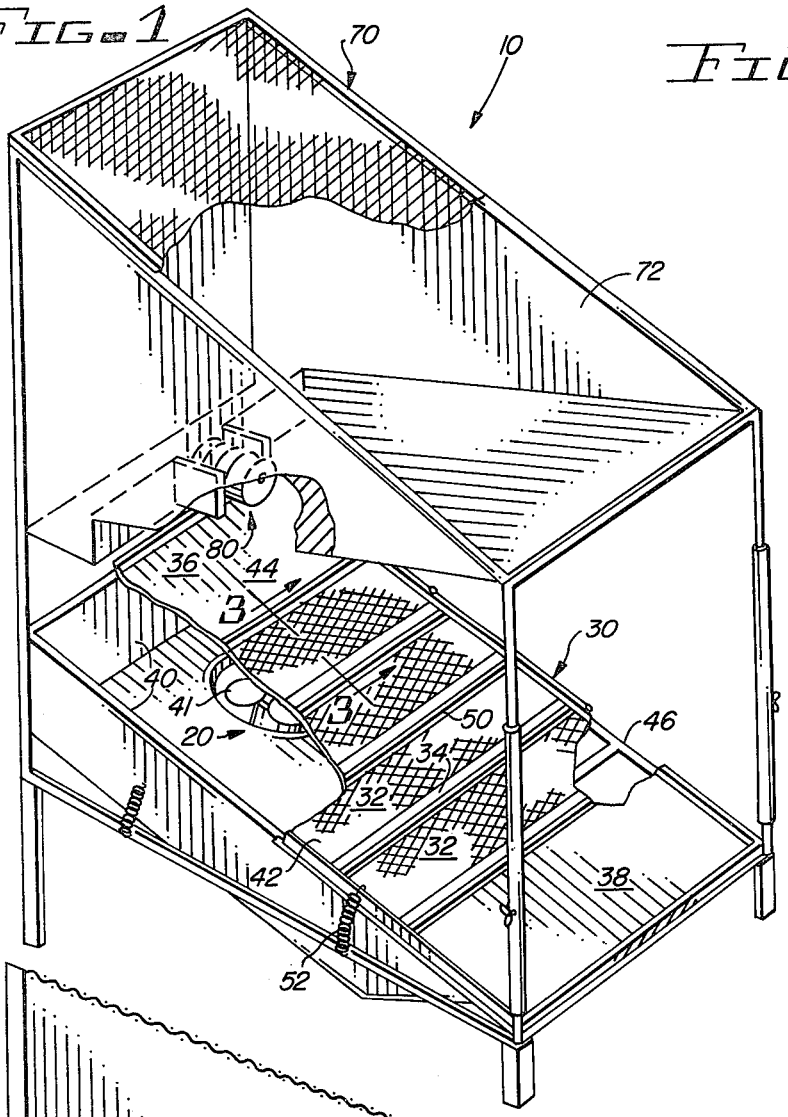
FIG. 3
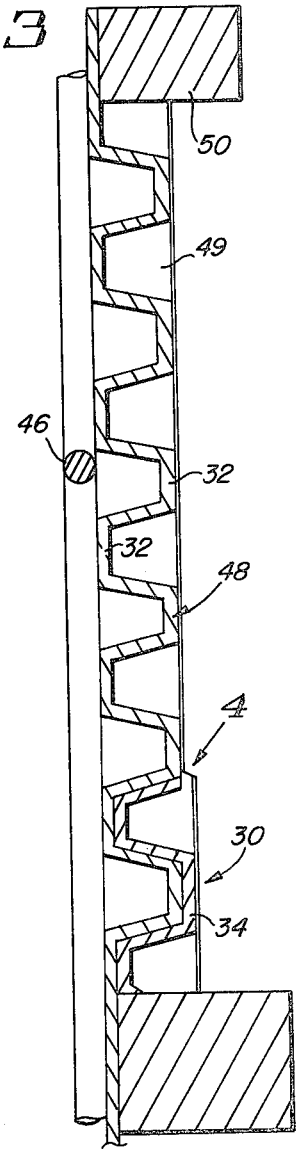
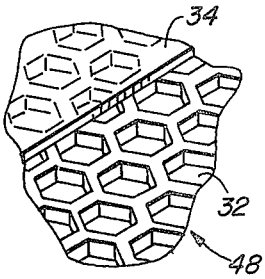
FIG. 4
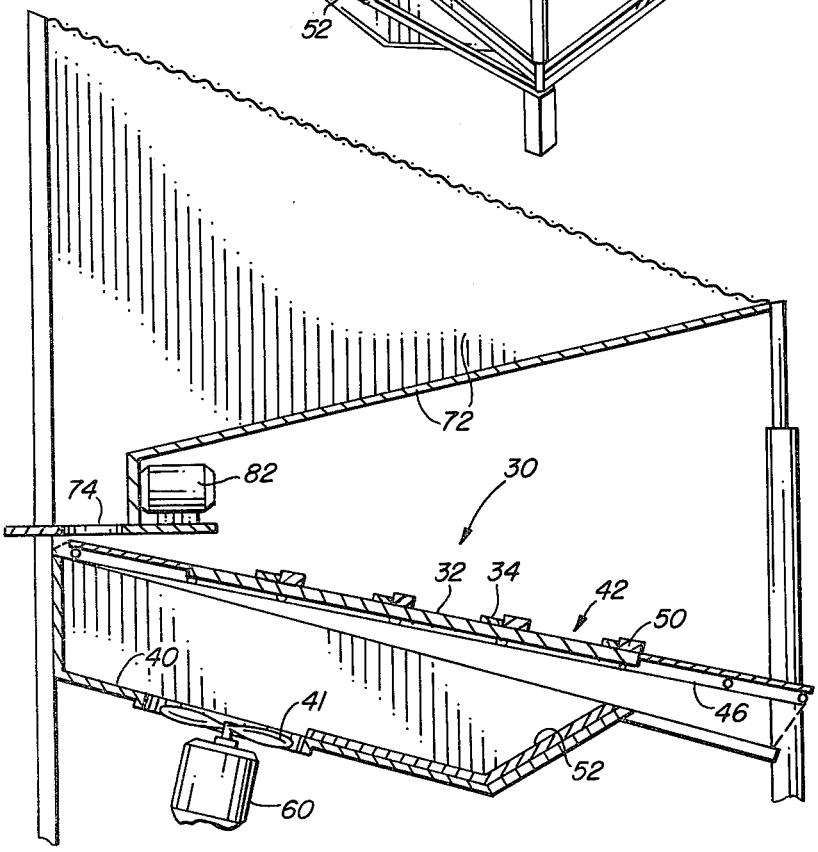
FIG. 2

APPARATUS FOR REFINING ORE

BACKGROUND OF THE INVENTION

1. Field of the Invention

This invention relates generally to refining apparatus and, more specifically, to a refining apparatus for separating the heavier constituents from a mixture of materials.

2. Description of the Prior Art

In the past, achieving a separation of a mixture of materials into heavier and lighter portions has been a recurring problem in various fields. One such field has been the separation of precious minerals from their natural habitat.

Gold, a typical one of such minerals, has been the subject of such attempts at separation, or refining, from time immemorial. The traditional approach to the separation of free, or placer, gold has been to deposit the mixture of materials in a flow of water passing through a sluice, or riffle, box. When entrained in such a flow, the various constituents of the mixture of materials were fluidly suspended, thereby permitting any gold, or other heavy materials such as rubies, sapphires, diamonds, etc., to descend to the bottom of the sluice box. Typically, the sluice box was provided with a series of riffle boards coupled to the bottom of the sluice box at right angles to the direction of the flow of water. In this manner, the heavy materials descending to the bottom of the sluice box were trapped behind the respective riffle boards. The most serious limitation on such a water sluice was the requirement for water. As free gold is commonly found in arid areas, such a water sluice was either totally inoperable or, at best, useful during only a limited portion of the year when water was available.

In an attempt to overcome this problem, various dry washer devices have been developed. As described in a 1961 Arizona Bureau of Mines publication entitled *Gold Placers and Placering in Arizona,* typical dry washers utilized a cloth-bottomed, inclined separating tray, through which air was pulsed to separate the heavier components. As the air passing upward through the cloth also tended to fluidly suspend the gold, the relative efficiency of such devices was limited. A need existed for a dry washer which would permit the heavier components of a mixture of materials to be fall out of the fluid suspension caused by the upwardly moving air.

BRIEF DESCRIPTION OF THE DRAWING

Referring to FIG. 1, a perspective elevational view of the herein disclosed refining apparatus is shown with portions removed for clarity.

Referring to FIG. 2, a sectional elevational view FIG. 1 is shown.

Referring to FIG. 3, an enlarged sectional elevational view taken along line 3—3 of FIG. 1 is shown.

Referring to FIG. 4, illustrated is an enlarged perspective view as taken in direction shown by reference number 4 in FIG. 3.

SUMMARY OF THE INVENTION

In accordance with one embodiment of this invention, it is an object to provide a refining apparatus for separating the heavier constituents of a mixture of materials.

It is another object to provide a refining apparatus for fluidly suspending a mixture of materials with a combination of vibration and a flow of air passing through the mixture.

It is a further object to provide a refining apparatus having a porous surface for conducting the airflow upwardly to assist in fluidly suspending the various constituents of the mixture of materials.

It is again another object to provide a refining apparatus having a porous surface for conducting the airflow upward, which porous surface is provided with impermeable regions to permit the heavier constituents of the mixture to be sheltered from the upward flow and to collect on the impermeable regions.

It is yet a further object to provide a refining apparatus having a permeable cloth separating tray having an impermeable overlay applied to particular regions of the upper surface of the cloth immediately adjacent to riffle boards to that the heavier components of the mixture can collect on the impermeable overlay regions.

It is still another object to provide a refining apparatus having an airbox beneath a permeable separating tray, with the airbox having cloth lined portions so that portions of the mixture of materials upon the tray which sift through the permeable regions can collect on the cloth lined portions.

It is another object to provide a refining apparatus having a honeycomb surfaced permeable separating tray so that the heavier portions of the mixture being refined can be effectively trapped within the convolutions of the honeycomb surface.

DESCRIPTION OF THE PREFERRED EMBODIMENT

In accordance with one embodiment of this invention, a refining apparatus for separating heavier constituents from a mixture of materials is disclosed, comprising: aerating means having a mixture support surface provided with at least alternating permeable and impermeable regions on the surface for fluidly suspending at least portions of the mixture above the surface; and vibrating means coupled to the refining apparatus for shaking the mixture of materials so that the heavier portions tend to migrate to the surface and further so that the heavier portions tend to come to rest on the impermeable regions.

In accordance with another embodiment of the invention, a method for separating the heavier constituents from a mixture of materials is disclosed, comprising the steps of: fluidly suspending the mixture above a surface; the step of fluidly suspending comprising the step of passing air upwardly through the surface; and providing the surface with impermeable regions so that the heavier constituents tend to collect on the impermeable regions.

The foregoing and other objects, features and advantages will be apparent from the following, more particular, description of the preferred embodiments of the invention, as illustrated in the accompanying drawings.

Referring to FIG. 1, a perspective elevational view of a refining apparatus for separating the heavier constituents from a mixture of materials is shown generally by reference number 10, with portions removed for clarity. The refining apparatus 10 is provided with aerating means, shown generally by reference number 20, and vibrating means shown generally by reference number 80. The aerating means 20, which are provided with a mixture support surface shown generally by reference number 30, are for fluidly suspending at least portions of the mixture of materials above the surface 30. The mixture support surface 30 is provided with alternating permeable and impermeable regions 32, 34 (refer also to FIG. 3). The vibrating means 80, which are provided with a substantially rigid coupling to the other portions of the refining apparatus 10, are for shaking the refining apparatus 10, and the mixture of materials, so that the heavier portions of the mixture of materials 10 tend to migrate to the surface 30, and further so that the heavier portions tend to come to rest on the impermeable regions 34.

The mixture support surface 30 is provided with an inlet end 36 and an outlet end 38. The aerating means 20 are provided with an airbox 40, which channels a flow from blower means shown generally by reference number 60 upwardly through the permeable regions 32. The airbox 40 is provided with non-porous regions, including the sides, ends and bottom. The airbox 40 also has an inlet aperture 41 through which the blower means 60 forces the airflow into the airbox 40. The airbox 40 is further provided with a tray 42 which forms the upper boundary of the airbox 40. The mixture support surface 30 comprises at least a portion of the uppermost surface of the tray 42. The region of the tray 42 at the inlet end 36 is comprised of a plate 44. The plate 44 is fabricated from a relatively rigid material such as steel, to withstand the continued impact of the mixture of materials upon the mixture support surface, as for example when the mixture flows from a feeder means as shown generally by reference number 70. The feeder means 70 hold a quantity of the unrefined mixture of materials in a feed hopper 72, and allow the unrefined mixture to fall upon the support surface 30 through a feed aperture 74 (Refer to FIG. 2).

Referring also to FIG. 2, a sectional elevational view FIG. 1 is shown. The tray 42 is provided with a frame 46 which supports a fabric sheet 48, (Refer also to FIG. 3). The fabric sheet 48 is preferably comprised of a porous fabric, and comprises the permeable regions 32. The fabric sheet 48 is divided into a series of panels by plurality of riffle boards 50. The impermeable regions 34 are located upon each of the panels of fabric sheet 48 immediately adjacent the inlet end 36 side of each of the riffle boards 50, which are individually coupled to the sheet 48. The tray 42, which is shown partially removed, is releaseably attached to, and biased against, the other portions of the refining apparatus 10 by a plurality of spring clips 52 (Refer to FIG. 1).

The mixture of materials tends to flow over the mixture support surface 30 due to the combination of downward slope of the support surface 30 toward the outlet end 38 and gravity. The heavier constituents of the mixture of materials tend to migrate downwardly through the bulk of the mixture due to the fluid suspension provided by the aerating means 20 and the vibration provided by the vibrating means 80, as for example an electro-mechanical vibrator 82. Even though the heavier constituents may reach the mixture support surface 30, the tendency of the aerating means 20 and the vibrating means 80 is to maintain the entirety of the mixture in fluid suspension, thereby allowing at least portions of the heavier constituents to pass toward the outlet end 38 along with the rest of the bulk of the mixture. However, each of the impermeable regions 34, occuring at the lowest end of a particular panel of the fabric sheet 48, creates a localized dead air space which terminates the tendency of the aerating means 20 to fluidly suspend that portion of mixture of materials occupying that dead air space. Since the heavier constituents have generally migrated to the support surface 30, they will tend to occupy the dead air space immediately above the impermeable regions 34. Furthermore, the combination of each of the impermeable regions 34 and the corresponding one of riffle boards 50 forms an angular channel having an apex at a lowest region thereof. The continued vibration of the vibrating means 80 tends to move the heaviest portions of the mixture of materials in the direction of gravitational pull, thereby trapping those heaviest constituents at the apex of each of the angles formed by are of the impermeable region 34 and the corresponding riffle board 50.

In the preferred embodiment of the refining apparatus 10, the interior surfaces of the airbox 40 are lined with a fabric layer 52. Illustrated is the V-section of the airbox 40 which defines the nadir thereof. The fabric layer 52, flanking the nadir, is particularly valuable for collecting those portions of the heavier constituents from the mixture of materials which sift through the permeable regions 32 of the fabric sheet 48.

Referring then to FIG. 3, a sectional view taken along line 3—3 is shown. The section of FIG. 3 reveals the structure of an individual one of the panels of the tray 42, and describes that structure with reference numbers in accord with those used with respect to FIGS. 1 and 2.

Referring also to FIG. 4, an enlarged perspective view taken in the direction of arrow 4 of FIG. 3, it can be seen that the preferred embodiment of the refining apparatus 10 utilizes a fabric sheet 48 which is provided with a multitude of pockets 49. It has been found that such a contoured fabric is particularly effective in collecting fine particles of the heaviest constituents of a mixture of materials. In the preferred embodiment of the refining apparatus 10, the impermeable region 34 is comprised of an overlay upon the fabric sheet 48. It has been found that curable silicon rubber is particularly adapted to be applied directly to the upper surface of the fabric sheet 48 to establish the impermeable regions 34 in the desired areas.

While the invention has been particularly described and shown in reference to the preferred embodiments thereof, it will be understood by those skilled in the art that various changes in form and detail and omissions may be made therein without departing from the spirit and scope of the invention.

What is claimed is:

1. A refining apparatus for separating the heavier constituents from a mixture of materials, comprising:

aerating means having a mixture support surface provided with at least alternating permeable and impermeable regions on said surface for fluidly suspending at least portions of said mixture above said surface;

vibrating means coupled to said aerating means for shaking said mixture of materials so that said heavier portions tend to migrate to said surface and further so that said heavier portions tend to come to rest on said impermeable regions; and said support surface having a honeycomb-patterned plurality of pockets on at least the upper surface of the permeable region thereof.

2. A refining apparatus in accordance with claim 1 wherein said mixture support surface having striated permeable and impermeable regions.

3. A refining apparatus for separating the heavier constituents from a mixture of materials according to claim 1 wherein said aerating means further comprising:

an air box having said support surface; and blower means for blowing a flow of air upward through said permeable regions.

4. A refining apparatus for separating the heavier constituents from a mixture of materials according to claim 3 wherein said aerating means further comprising:

said surface having an inlet end and an outlet end distal from said inlet end;

said surface having a downward slope from said inlet end to said outlet end; and riffle boards individually coupled to said surface at the terminus of each of said impermeable regions proximal to said outlet end.

5. A refining apparatus for separating the heavier constituents from a mixture of materials according to claim 4 wherein said blower means having:

a blower for providing a flow; and a flow aperture into said airbox for receiving said flow.

6. A refining apparatus for separating the heavier constituents from a mixture of materials according to claim 5 wherein said aerating means further comprising:

said airbox having impermeable regions including impermeable ends, impermeable sides and an impermeable bottom;

a tray having said surface; and said tray comprising a top of said airbox.

7. A refining apparatus for separating the heavier constituents from a mixture of materials according to claim 6 wherein said tray comprising:

a frame; and a fabric sheet comprising at least said permeable region coupled to said frame.

8. A refining apparatus for separating the heavier constituents from a mixture of materials according to claim 7 wherein each of said impermeable regions comprising an overlay upon said fabric sheet.

9. A refining apparatus in accord with claim 8 wherein said impermeable bottom of said airbox having:

a V-shaped longitudinal section defining a nadir; and a fabric layer flanking said nadir.

10. A refining apparatus for separating the heavier constituents from a mixture of materials, comprising:

aerating means having a mixture support surface provided with at least alternating permeable and impermeable regions on said surface for fluidly suspending at least portions of said mixture above said surface;

vibrating means coupled to said aerating means for shaking said mixture of materials so that said heavier portions tend to migrate to said surface and further so that said heavier portions tend to come to rest on said impermeable regions; and said support surface having a honeycomb-patterned plurality of pockets on at least the upper surface of the impermeable region thereof.

* * * * *